US005934913A

United States Patent [19]

Kodama

[11] Patent Number: 5,934,913

[45] Date of Patent: Aug. 10, 1999

[54] BOARD MOUNTING-TYPE CONNECTOR

[75] Inventor: Shinji Kodama, Shizuoka, Japan

[73] Assignee: Yazaki Corporation, Tokyo, Japan

[21] Appl. No.: 09/025,774

[22] Filed: Feb. 19, 1998

[30] Foreign Application Priority Data

Feb. 19, 1997 [JP] Japan ..... 9-35026

[51] Int. Cl.[6] ..... H01R 9/09

[52] U.S. Cl. ..... 439/76.1; 439/557

[58] Field of Search ..... 439/76.1, 562, 439/557

[56] References Cited

U.S. PATENT DOCUMENTS

| | | | |
|---|---|---|---|
| 5,330,630 | 7/1994 | Marsh et al. | 439/76.1 |
| 5,364,279 | 11/1994 | Betz et al. | 439/76.1 |
| 5,409,385 | 4/1995 | Tan et al. | 439/76.1 |
| 5,413,490 | 5/1995 | Tan et al. | 439/76.1 |

FOREIGN PATENT DOCUMENTS 4-277474 10/1992 Japan .

*Primary Examiner*—Gary Paumen

*Attorney, Agent, or Firm*—Sughrue, Mion, Zinn, Macpeak & Seas, PLLC

[57] ABSTRACT

A board mounting-type connector in which an external force, applied to the connector, will not act directly on solder portions on the connector, and the efficiency of an assembling operation is high. A board mounting-type connector (6) is fixed to a board (10) supported within an equipment body (16), and projects outwardly from a connector opening (18) formed in an equipment cover (7) which cooperates with the equipment body to cover the board (10). Board terminals (8) are soldered at their one ends (8*a*) to the board (10), and other end portions (8*b*) of the board terminals are received in the connector. Connector-supporting projections (14) are formed on an outer peripheral surface of that portion of the connector projecting outwardly from the connector opening (18), and the connector-supporting projections abut against a peripheral edge portion of the connector opening (18) so that an external force, applied to the connector in a direction toward the board (10), can be supported by the equipment cover (7).

7 Claims, 6 Drawing Sheets

BOARD MOUNTING-TYPE CONNECTOR

BACKGROUND OF THE INVENTION

1. Field of the Invention

This invention relates to a board mounting-type connector for attachment to a board.

2. Related art

FIG. 8 shows a board mounting-type connector 1 (disclosed in Japanese Utility Model Unexamined Publication No. 4-277474), a terminal 2 received in the connector 1, and a circuit board 4 to which one end 3 of the terminal 2 is fixedly secured. In this construction, the connector 1 is beforehand fixedly mounted on a frame 5, and the one end 3 of the terminal, received in this connector 1, is fixed to the circuit board 4 by soldering, thereby assembling this construction.

However, in order to fix the circuit board 4 to the one end 3 of the terminal 2 it is necessary to move the circuit board so that the end 3 of the terminal is received in slot 50 having a V-shaped inlet portion 51. In this condition soldering is effected. This operation is rather difficult, and the efficiency of the operation is very poor.

Therefore, there may be proposed a construction in which a connector is initially fixed to a board, and a terminal, received in this connector, is likewise initially fixed by soldering to a reverse side of the board with the opposite end of the terminal received in the connector. With this construction, the soldering is not effected at a later stage. Therefore the efficiency of the operation is improved.

However, the problem with this construction is that when an external force is applied to the connector, this force acts directly on the solder portion, which may result in the formation of cracks in the solder portion.

In order to overcome this problem, there may be proposed a construction in which the connector, initially fixed to the board, is fixed, for example, to a cover of equipment covering the board, or a frame (as described above) so that a force, applied to the connector, will not act directly on the solder portion. In this case, however, the connector must be fixed to the equipment cover or the frame, and therefore the time and labor required for the operation are increased.

Further, since the connector is initially fixed to the board, there is a possibility that an undue force may be applied to the board when fixing the connector to the equipment cover or the frame. Therefore, when fixing the connector to the equipment cover or the frame, it is necessary to provide such a construction which will not adversely affect the board.

It is therefore an object of this invention to provide a board mounting-type connector in which an external force, applied to the connector, will not act directly on solder portions on the connector, and in which the efficiency of an assembling operation is good.

SUMMARY OF THE INVENTION

The above object has been achieved by a board mounting-type connector wherein the connector is fixed to a board supported within an equipment body, and projects outwardly from a connector opening formed in an equipment cover which cooperates with the equipment body to cover the board, and board terminals are soldered at their one ends to the board, and other end portions of the board terminals are received in the connector. According to the invention, connector-supporting projections are formed on an outer peripheral surface of that portion of the connector projecting outwardly from the connector opening, and the connector-supporting projections abut against a peripheral edge portion of the connector opening so that an external force, applied to the connector in a direction toward the board, can be supported by the equipment cover.

Specifically, in this board mounting-type connector, when an external force is applied to the connector toward the board, the connector-supporting projections abut against the peripheral edge portion of the connector opening, so that this external force is supported by the equipment cover. As a result, the force is not applied to the board through the connector, and therefore will not act directly on solder portions fixing the board terminals to the board.

This board mounting-type connector is fixed in advance to the board, and also the board terminals, received in the connector, are soldered in advance to the board. Thus, the soldering operation is not effected at a later stage, and the efficiency of the assembling operation is high.

The connector-supporting projections are not fixed to the equipment cover, but are merely abutted against the peripheral edge portion of the connector opening, and thus it is not necessary to fix the connector to the equipment cover, and therefore this also enhances the efficiency of the assembling operation.

Further, the connector-supporting projections project from the outer peripheral surface of the connector, and are elastic so that they can be deformed to lie flush with the outer peripheral surface.

Specifically, when the connector is passed through the connector opening, the connector-supporting projection is elastically deformed to lie flush with the outer peripheral surface of the connector, and the connector-supporting projection, when passed beyond the connector opening, is restored into its original shape because of its own elasticity. Therefore, high efficiency of the assembling operation is achieved when attaching the connector to the equipment cover.

Further, each of the connector-supporting projections has at its distal end a slanting surface for abutment against an edge of the connector opening. The distal end of the connector-supporting projection abuts against the edge of the connector opening, and therefore the accidental deformation of the connector-supporting projection is prevented, and any external force applied to the connector can be stably supported by the equipment cover.

Still further, each of the connector-supporting projections is constituted by an arm portion, which lies flush with the outer peripheral surface of the connector, and is elastically deformable inwardly, and an outwardly-directed projected portion which is formed at a distal end of the arm portion. The projected portion has an abutment surface for abutting against the peripheral edge portion of the connector opening.

In this board mounting-type connector, since the arm portion is disposed flush with the outer peripheral surface, the connector-supporting projection is less likely to be flexed against an external force applied to the connector in a direction toward the board. Therefore, the connector-supporting projection will not be flexed outwardly upon application of an external force, and the external force can be positively supported by the equipment cover.

According to the invention, at least one pair of connector-supporting projections are provided, and the pair of connector-supporting projections are disposed in opposed relation to each other. Accordingly, an external force applied to the connector is stably supported by the equipment cover against which the pair of connector-supporting projections are abutted.

According to a further aspect of the invention, the connector includes a housing portion which supports the board terminals passing therethrough, board-fixing portions which fix the housing portion to a front surface of the board, and a hood portion which is formed integrally with the housing portion, and is adapted to receive a mating connector therein. Further, the board terminals project into the interior of the hood portion, and the connector-supporting projections are formed integrally on the hood portion.

DETAILED DESCRIPTION OF THE INVENTION

A preferred embodiment of a board mounting-type connector of the present invention will now be described.

Figure 1:
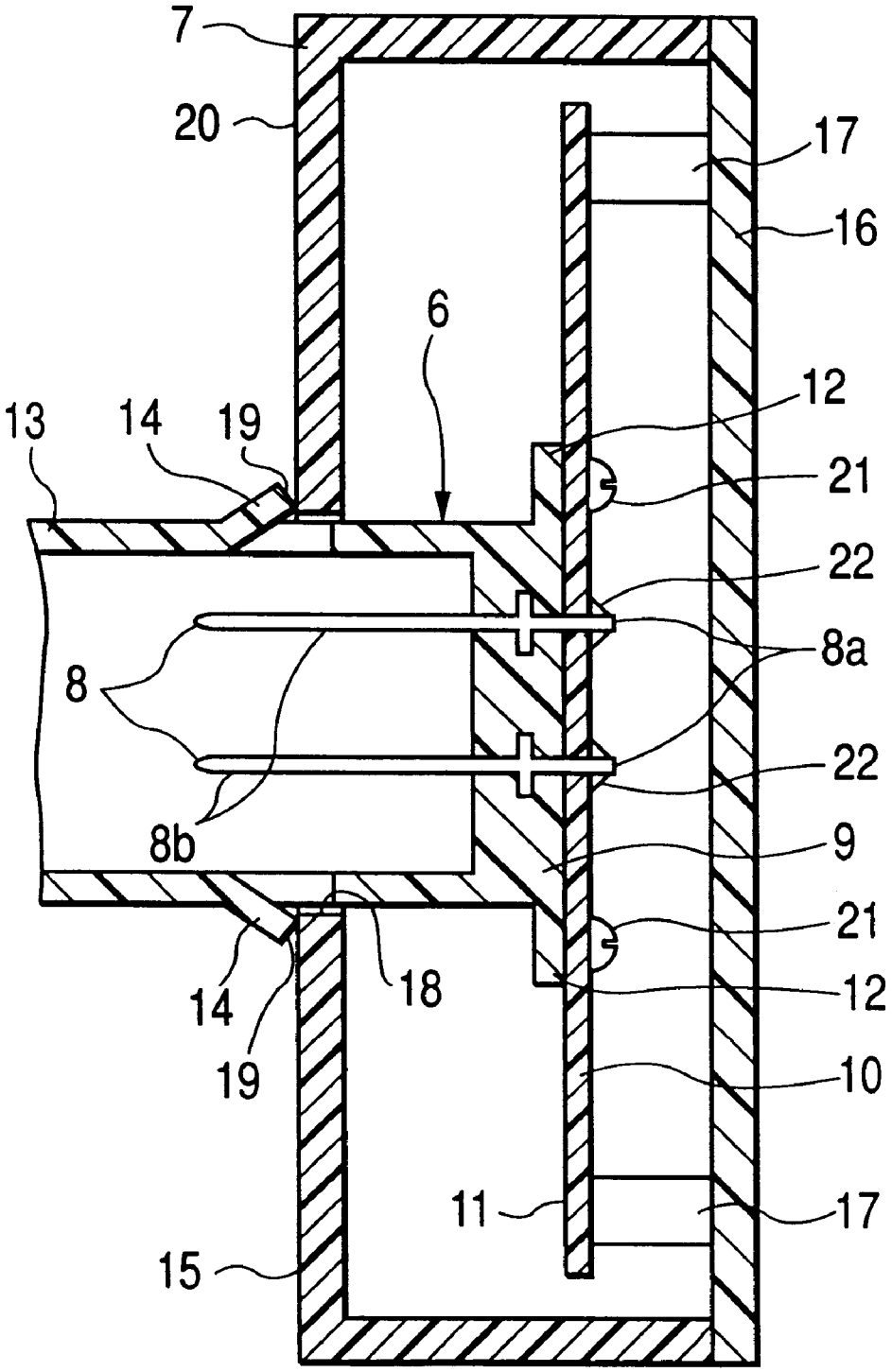
FIG. 1 is a cross-sectional view showing a first embodiment of a board mounting-type connector of the invention, a board to which this connector is mounted, an equipment body and an equipment cover.
Figure 2:
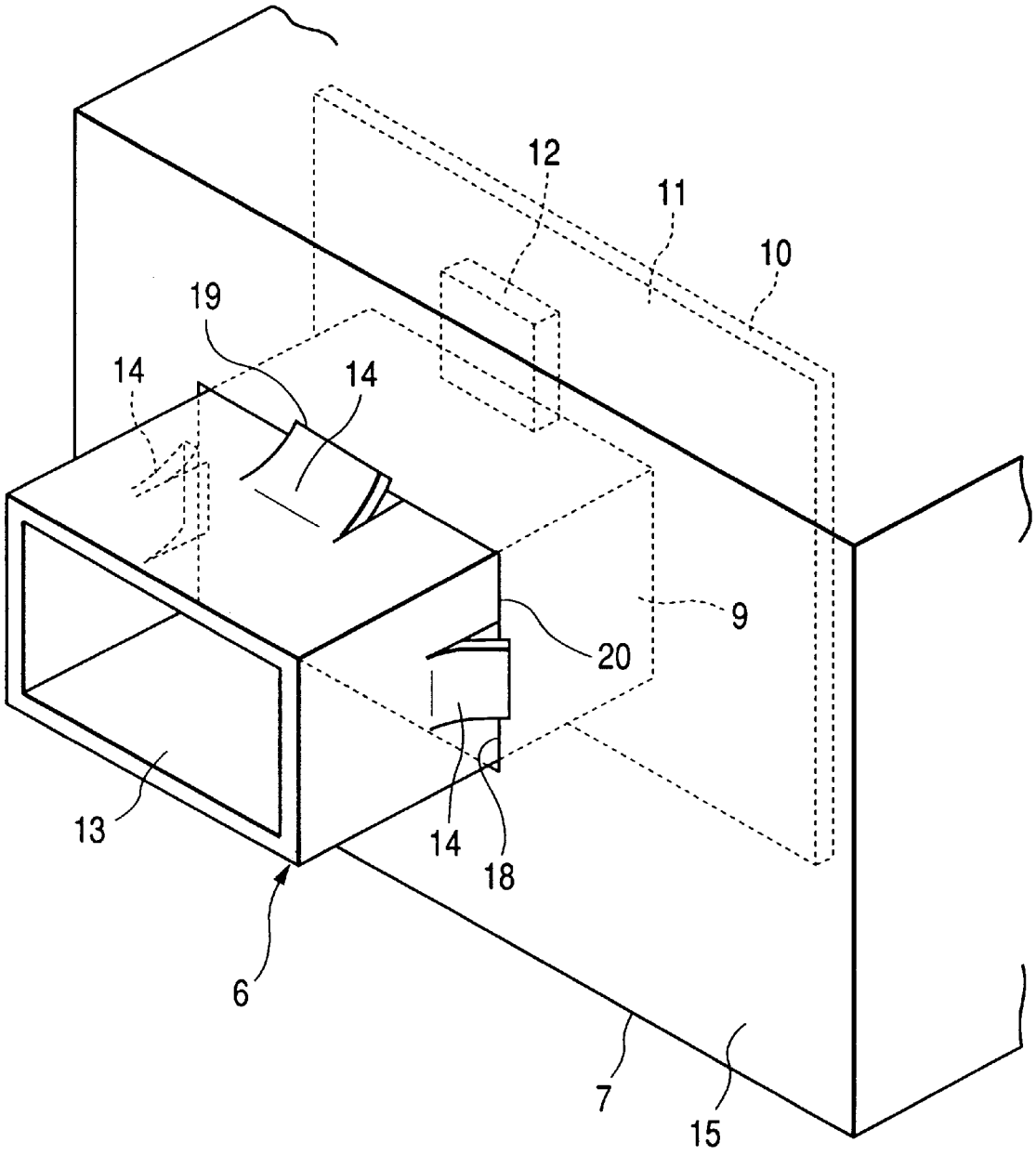
FIG. 2 is a perspective view showing the board mounting-type connector of the first embodiment, the board, the equipment body and the equipment cover.
Figure 3:
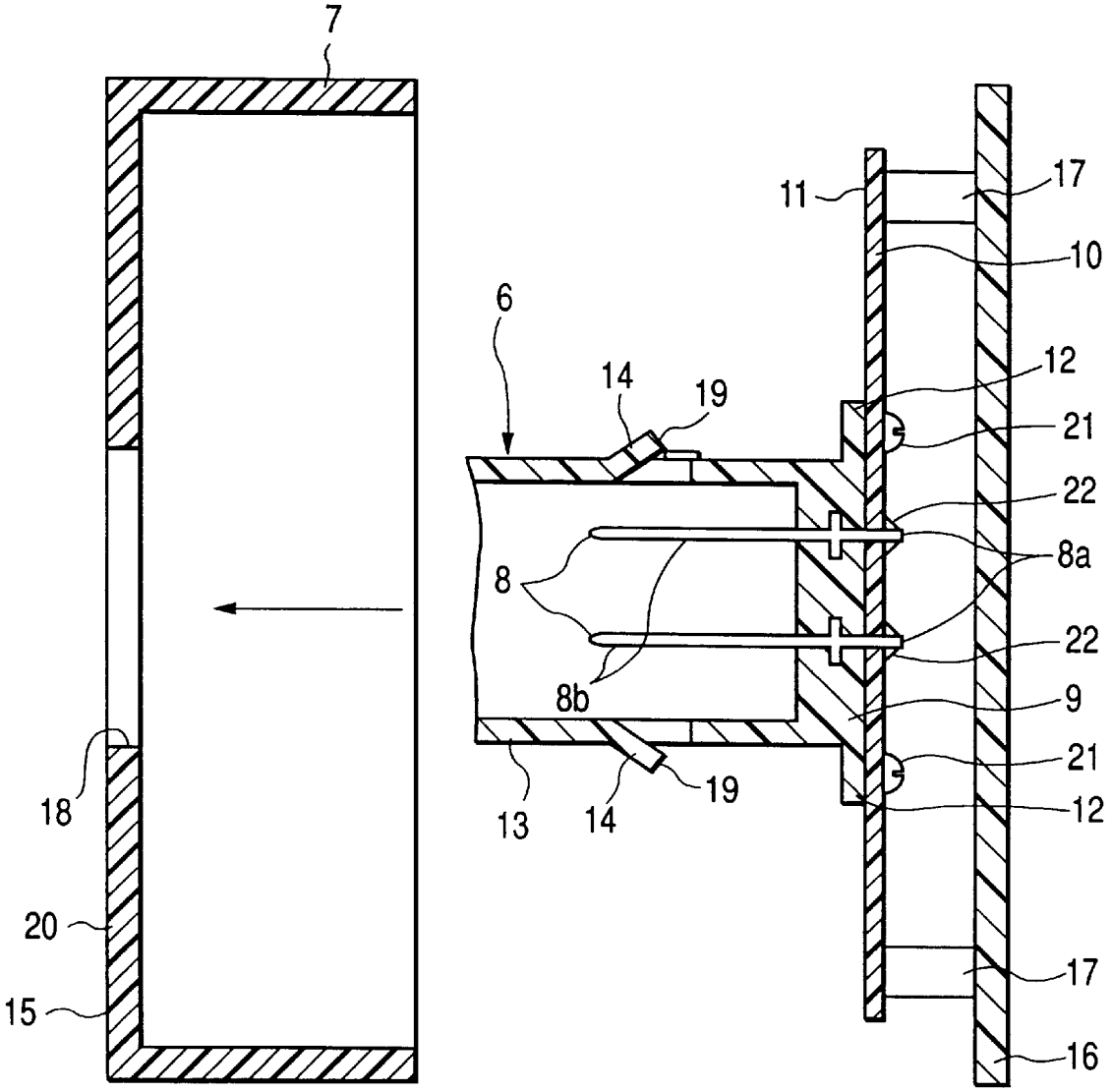
FIG. 3 is a cross-sectional view showing a condition before the board mounting-type connector of the first embodiment is attached to the equipment cover.

FIG. 1 is a cross-sectional view showing a board mounting-type connector 6 attached to an equipment cover 7, and FIG. 2 is a perspective view showing this condition. FIG. 3 is a cross-sectional view showing a condition before the board mounting-type connector 6 is attached to the equipment cover 7.

As shown in FIGS. 1 to 3, the board mounting-type connector 6 includes a housing portion 9 which supports board terminals 8 passing therethrough, board-fixing portions 12 which fix the housing portion 9 to a front surface 11 of a board 10, and a hood portion 13 which is formed integrally with the housing portion 9, and is adapted to receive a mating connector (not shown) therein. The board terminals 8 project into the interior of the hood portion 13. Connector-supporting projections 14 extend from the hood portion 13.

In more detail, the connector-supporting projections 14 are formed on an outer peripheral surface of the hood portion 13, and are directed outwardly. Further, the connector-supporting projections are so elastic that they can be elastically deformed to lie flush with the outer peripheral surface of the hood portion 13. The connector-supporting projections 14 are formed respectively on four sides of the hood portion 13, which has a rectangular cross-section, and the projections 14, formed respectively on each pair of opposed sides of the hood portion 13, are disposed in opposed relation to each other. One end portion 8*a* of each of the board terminals 8 extends through the board 10 (to which the board mounting-type connector 6 is fixed by the board-fixing portions 12), and is soldered to a reverse surface of the board 10. The other end portion of each of the board terminals 8 projects into the interior of the hood portion 13 of the board mounting-type connector 6. The board 10 is fixedly secured to bosses 17 and 17 formed on an equipment body 16. One side of the equipment body 16 is covered with the equipment cover 7, so that the board 10 is received in a space formed between the equipment body 16 and the equipment cover 7.

A connector opening 18 of a rectangular shape, which is slightly larger than the board mounting-type connector 6, is formed in the equipment cover 7. When the board 10 is received in the space between the equipment body 16 and the equipment cover 7, the distal end portion of the hood portion 13 projects outwardly from the connector opening 18. In this condition, distal ends of the connector-supporting projections 14, formed on the hood portion 13, abut against a peripheral edge portion 20 of the connector opening 18.

Specifically, when the board 10 is to be covered with the equipment cover 7, the hood portion 13 is passed through the connector opening 18 (see FIG. 1), and at this time the connector-supporting projections 14 are brought into engagement with the peripheral edge portion of the connector opening 18. Then, the connector-supporting projections 14 are elastically deformed to lie flush with the outer peripheral surface of the hood portion 13, and then pass beyond the connector opening 18 whereupon the connector-supporting projections 14 are restored into their original shape (that is, are directed outwardly) because of their own elasticity.

In the drawings, reference numerals 21 denote fixing screws by which the board mounting-type connector 6 is fixedly secured to the board 10.

The procedure of mounting the board mounting-type connector 6 will now be described.

First, the board terminals 8 are supported in the housing portion 9. At this time, one end 8*a* of each of the board terminals 8 projects outwardly from the housing portion 9, and the other end portion 8*b* projects into the interior of the hood portion 13. Then, the board mounting-type connector 6 is fixedly secured to the front surface of the board 10, and the one end 8*a* of each of the board terminals 8, projecting outwardly from the housing portion 9, is inserted into an associated through holes (not shown) formed through the board 10. Thereafter, the board terminals 8 are soldered to the reverse surface of the board 10.

Thus, the board mounting-type connector 6 is fixed to the board 10 in advance, and the board terminals 8, mounted on the board mounting-type connector 6, are soldered and fixed to the board 10.

In this condition, the board 10 is fixed to the bosses 17 and 17 of the equipment body 16, and then the equipment cover 7 is attached from the front side of the board 10 to cover the same and is fixed to the equipment body 16. At this time, the distal end portion of the hood portion 13 of the board mounting-type connector 6 extends through the connector opening 18 in the equipment cover 7, and the connector-supporting projections 14, after passing beyond the connector opening 18, abut against the outer surface of the equipment cover 7. As a result, the equipment body 16, the equipment cover 7, the board 10 and the board mounting-type connector 6 are assembled together.

In a condition in which the board mounting-type connector 6 is connected to the equipment body 16 and the equipment cover 7, when an external force is accidentally applied to the distal end of the hood portion 13 in a direction toward the board 10, the connector-supporting projections 14 abut against the outer surface of the equipment cover 7, so that this force is supported by the equipment cover 7. Therefore, this force will not cause the hood portion 13 to push against the board 10, the external force will not act directly on solder portions fixing the board terminals 8 to the board 10. Thus, the solder portions 22 will not be damaged.

In this embodiment, the board mounting-type connector 6 is fixed to the board 10 in advance, and also the board terminals 8, received in the board mounting-type connector 6, are fixed to the board 10 in advance by soldering. Thus the soldering is not effected at a later stage. Therefore, the efficiency of the assembling operation is high.

Further, as noted above, the connector-supporting projections 14 on the board mounting-type connector 6 are elastic, and it is only necessary to pass the hood portion 13 through the connector opening 18 in the equipment cover 7. Accordingly, the board mounting-type connector 6 can be easily attached to the equipment cover 7.

In this embodiment, since the opposed connector-supporting projections 14 are formed on the hood portion 13, an external force, applied to the hood portion 13, can be stably supported by the peripheral edge portion of the connector opening 18.

Next, other embodiments will be described with reference to FIGS. 4 to 7. Those portions identical to those of the first embodiment will be designated by identical reference numerals, respectively, and explanation thereof will be omitted.

Figure 4:
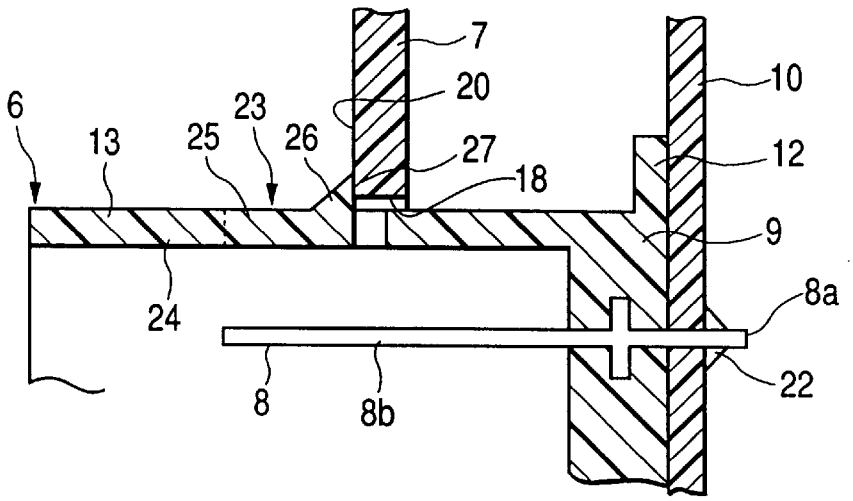
FIG. 4 is a cross-sectional view showing a connector-supporting projection in a second embodiment of a board mounting-type connector of the invention.

A second embodiment, shown in FIG. 4, will now be described. In this embodiment, each of connector-supporting projections 23 is constituted by an elastic arm portion 25, disposed flush with a wall portion 24 of the hood portion 13, and an outwardly-directed projected portion 26 which is formed on a distal end of the arm portion 25. The projected portion 26 has a flat abutment surface 27 for abutting against a peripheral edge portion 20 of a connector opening 18.

When the hood portion 13 is passed through the connector opening 18, the arm portion 25 of the connector-supporting projection 23 is flexed inwardly of the hood portion 13 so as to allow the projected portion 26 to pass beyond the connector opening 18. After the projected portion 26 passes beyond the connector opening 18, the arm portion 25 is restored into its original position because of its own elasticity, so that the abutment surface 27 of the projected portion 26 abuts against the peripheral edge portion 20 of the connector opening 18.

In this embodiment, effects as described above for the first embodiment are obtained. Further, each arm portion 25 is normally held flush with the wall portion 24 of the hood portion 13, and the abutment surface 27 of the projected portion 26 abuts flat against the peripheral edge portion 20 of the connector opening 18. With this construction, the arm portion 25 is less liable to be deformed against an external force applied to the hood portion 13, and enables a greater external force to be positively supported by an equipment cover 7.

Figure 5:
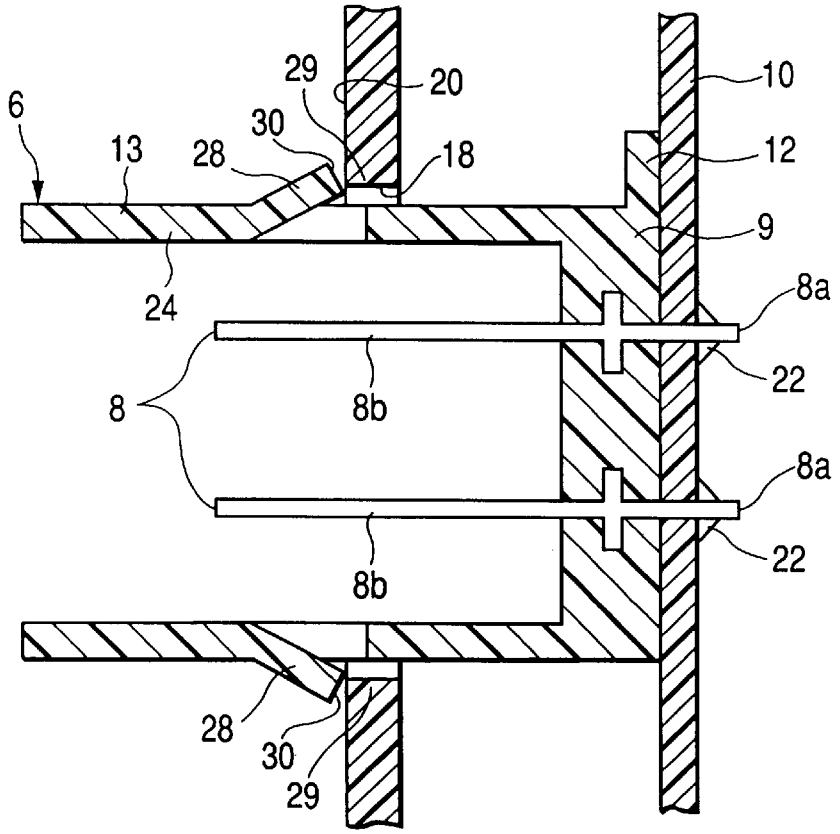
FIG. 5 is a cross-sectional view showing a third embodiment of a board mounting-type connector of the invention.
Figure 6:
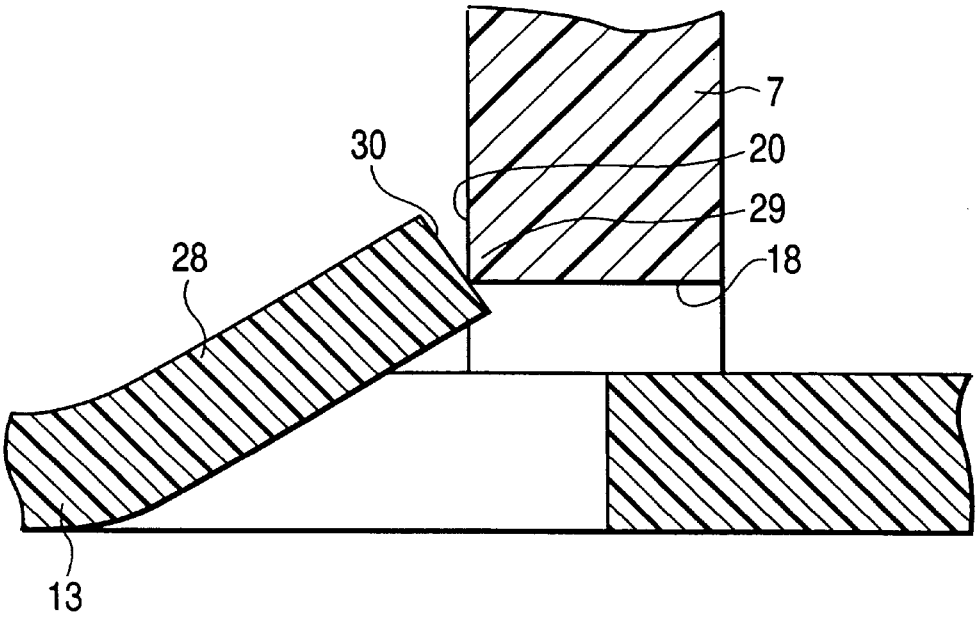
FIG. 6 is a cross-sectional view showing a connector-supporting projection in the board mounting-type connector of the third embodiment.

A third embodiment, shown in FIGS. 5 and 6, will now be described. In this embodiment, as shown in FIGS. 5 and 6, each of connector-supporting projections 28 has at its distal end a slanting surface 30 for abutment against an edge 29 of a connector opening 18.

When a hood portion 13 is passed through the connector opening 18, the connector-supporting projection 28 is flexed to lie flush with an outer peripheral surface of the hood portion 13, and is passed beyond the connector opening 18. After the connector-supporting projection 28 has passed beyond the connector opening 18, the slanting surface 30 abuts against the edge 29 of the connector opening 18, as shown in FIG. 6.

In this embodiment, effects as described above for the first embodiment are obtained. Further, since the slanting surface 30 abuts against the edge 29 of the connector opening 18, the connector-supporting projection 28 is less liable to be deformed outwardly against an external force applied to the hood portion 13, and enables a greater external force to be positively supported by an equipment cover 7.

Figure 7:
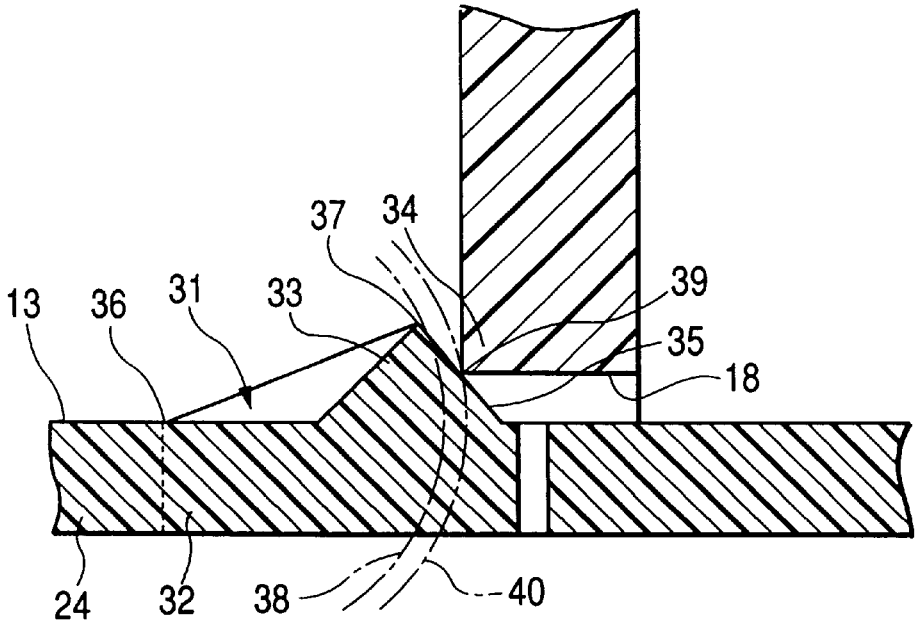
FIG. 7 is a cross-sectional view showing a connector-supporting projection in a fourth embodiment of a board mounting-type connector of the invention.
Figure 8:
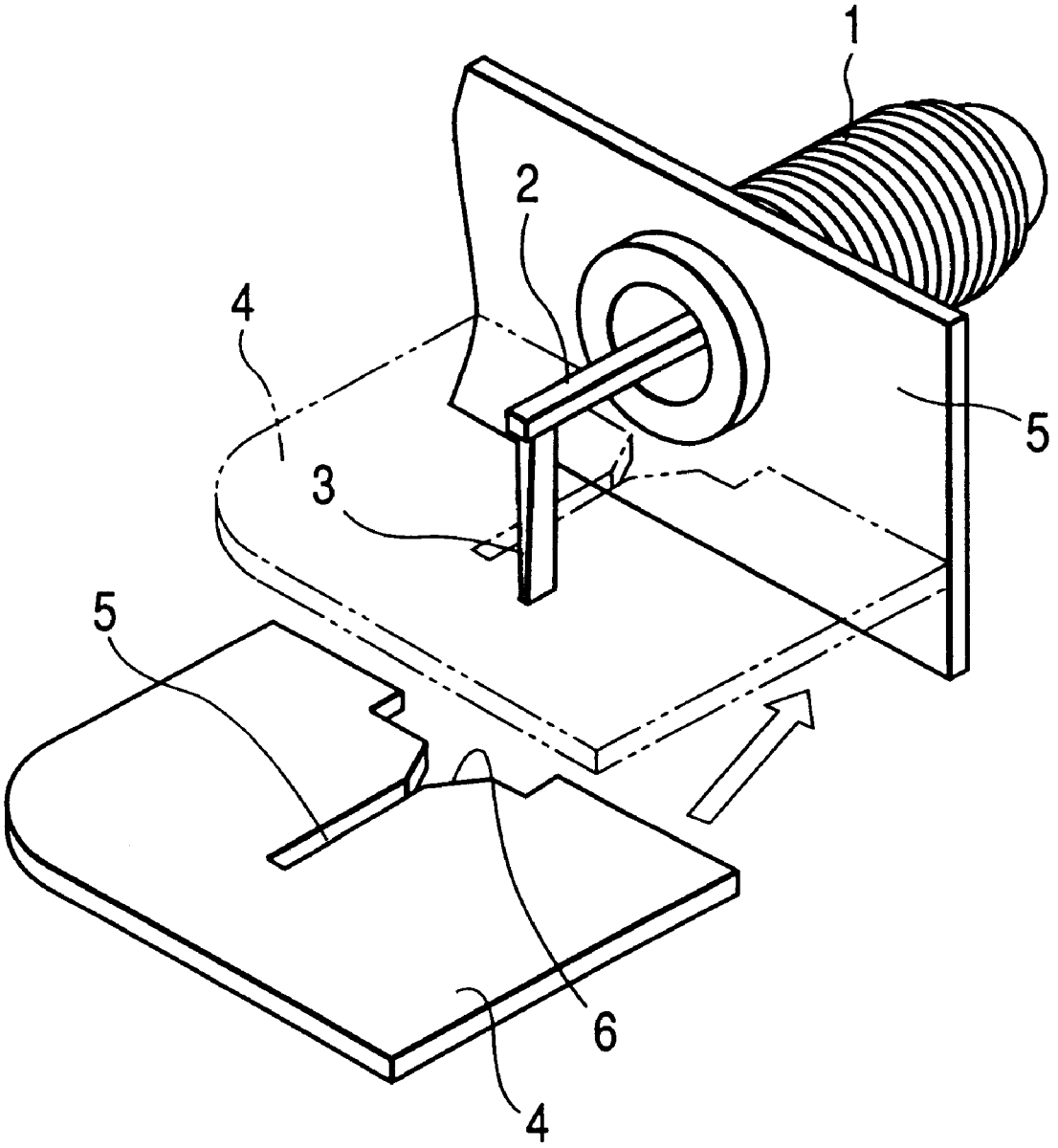
FIG. 8 PRIOR ART
FIG. 8 is a perspective view showing a conventional board mounting-type connector, a terminal received in this connector, and a circuit board to which the terminal is soldered at its one end.

A fourth embodiment, shown in FIG. 7, will now be described. In this embodiment, as shown in FIG. 7, each of connector-supporting projections 31 is constituted by an elastic arm portion 32, disposed flush with a wall portion 24 of a hood portion 13, and an outwardly-directed projected portion 33 formed on a distal end of the arm portion 32. The projected portion 33 has a slanting surface 35 for abutment against an edge 34 of a connector opening 18. The slanting surface 35 is so arranged that a path 40 of angular movement of an abutment point 39 (at which the slanting surface 35 abuts against the edge 34 of the connector opening 18) about a pivot axis 36 (about which the arm portion 32 is elastically deformed) is disposed farther (more remote) from the pivot axis 36 than a path 38 of angular movement of an apex 37 of the projected portion 33 about the pivot axis 36.

When the hood portion 13 is passed through the connector opening 18, the arm portion 32 of the connector-supporting projection 31 is flexed inwardly of the hood portion 13 so as to allow the projected portion 33 to pass beyond the connector opening 18. Thereafter, the arm portion 32 is restored into its original position because of its own elasticity, so that the abutment surface 35 of the projected portion 33 abuts against the edge 34 of the connector opening 18.

In this embodiment, effects as described above for the first embodiment are obtained. Further, each arm portion 32 is normally held flush with the wall portion 24 of the hood portion 13, and the slanting surface 35 of the projected portion 33 abuts against the edge 34 of the connector opening 18. With this construction, the arm portion 33 is less liable to be deformed against an external force applied to the hood portion 13, and enables a greater external force to be positively supported by an equipment cover 7.

I claim:

1. A board mounting-type connector which is received in a connector opening provided in an equipment cover and which is attached to a board supported by an equipment body which cooperates with said equipment cover to enclose said board, said connector comprising:

a connector housing which supports a plurality of board terminals, said connector housing being fixed to a front surface of said board with one end portions of said board terminals passing through said board and being soldered thereto, and other end portions of said board terminals extending into said connector housing; and a plurality of connector-supporting elastically deformable arms extending from said connector housing, said connector-supporting elastically deformable arms abutting against a peripheral edge portion of said connector opening so that an external force, applied to said connector in a direction toward said board, is supported by said equipment cover.

2. A board mounting-type connector according to claim 1, wherein said connector-supporting elastically deformable arms project from an outer peripheral surface of said connector housing, and are deformable to lie flush with said outer peripheral surface.

3. A board mounting-type connector according to claim 1, wherein each of said connector-supporting elastically deformable arms has at its distal end a slanting surface abutting against an edge of said connector opening.

4. A board mounting-type connector according to claim 1, wherein each of said connector-supporting elastically deformable arms includes an arm portion, which lies flush with the outer peripheral surface of said connector and is elastically deformable inwardly, and an outwardly-directed projected portion which is formed at a distal end of said arm portion, said projected portion having an abutment surface for abutment against the peripheral edge portion of said connector opening.

5. A board mounting-type connector according to claim 4, wherein said abutment surface is a slanting surface for abutting against an edge of said connector opening.

6. A board mounting-type connector according to claim 1, wherein at least one pair of said connector-supporting elastically deformable arms are provided, and said pair of connector-supporting elastically deformable arms are disposed in opposed relation to each other.

7. A board mounting-type connector according to claim 1, wherein said connector further comprises board-fixing portions which fix said connector housing to said front surface of said board, and a hood portion which is formed integrally with said connector housing, and is adapted to receive a mating connector therein, and said board terminals project into the interior of said hood portion, and said connector-supporting elastically deformable arms are formed integrally with said hood portion.

* * * * *